United States Patent [19]

Tokuda et al.

[11] Patent Number: 4,754,961

[45] Date of Patent: Jul. 5, 1988

[54] SHEET FEEDING CLUTCH MECHANISM FOR A SHEET FEEDING UNIT

[75] Inventors: Syunsuke Tokuda, Tokorozawa; Kouichiro Kitazume, Urawa, both of Japan

[73] Assignee: Daima Seiko Inc., Higashikurume, Japan

[21] Appl. No.: 25,265

[22] Filed: Mar. 12, 1987

[30] Foreign Application Priority Data

Mar. 31, 1986 [JP] Japan ..... 61-47712[U]

[51] Int. Cl.[4] ..... B65H 3/06

[52] U.S. Cl. ..... 271/114

[58] Field of Search ..... 271/9, 114, 115, 116

[56] References Cited

U.S. PATENT DOCUMENTS

| | | | |
|---|---|---|---|
| 2,887,208 | 5/1959 | Gross . | |
| 4,577,849 | 3/1986 | Watanabe | 271/116 X |
| 4,638,987 | 1/1987 | Sakurai | 271/116 X |

FOREIGN PATENT DOCUMENTS

| | | |
|---|---|---|
| 2910849 | 9/1983 | Fed. Rep. of Germany . |
| 57-1780 | 1/1982 | Japan . |
| 60-8054 | 1/1985 | Japan . |

*Primary Examiner*—Richard A. Schacher

*Attorney, Agent, or Firm*—Ladas & Parry

[57] ABSTRACT

A sheet feeding clutch mechanism for a sheet feeding unit comprises a drive disk rotatably mounted on a sheet feed shaft of the feeding unit, a clutch disk having a pawl guide groove on its outer peripheral surface, rotatably mounted on the feed shaft so as to be coaxially mounted adjacent to the drive disk, and a drive gear fixed to the feed shaft in the clutch disk. A ratchet pawl is pivoted to the drive disk, and slidably contacts the pawl guide groove of the clutch disk. While the drive disk rotates forwardly, the pawl engages the drive gear through a slit in the guide groove. A first initializing stop is formed in the guide groove of the clutch disk, for engaging the ratchet pawl when the drive disk rotates forwardly. A second initializing stop is formed on the outer peripheral surface of the clutch disk and engages the pawl during the reverse rotation of the drive disk.

4 Claims, 12 Drawing Sheets

SHEET FEEDING CLUTCH MECHANISM FOR A SHEET FEEDING UNIT

BACKGROUND OF THE INVENTION

1. Field of the Invention

The invention relates to a sheet feeding clutch mechanism for use in an automatic sheet feeding unit of a printer, and more particularly, to a sheet feeding clutch mechanism which rotates a sheet feed shaft only in one direction, and ensures the positioning of a drive disk with respect to a clutch disk.

2. Description of the Related Art

Conventionally, sheet feeding clutch mechanisms of this type have been used in printers incorporated in computer systems, office-automation systems, and the like, as is described in Japanese Patent Disclosure No. 1780/82.

In an automatic sheet feeding unit provided with such a conventional clutch mechanism, a drive unit in a printer unit provides both a driving force for feeding unprinted paper sheets from a first magazine to a platen of the printer unit, and a driving force for feeding printed sheets from the platen into a second magazine. Also, a control device in the printer unit sends control commands for feeding these sheets.

The sheets are fed from the first magazine to the platen of the printer unit by feed rollers of the sheet feeding unit. After being caught by the platen, the paper sheets are line-fed or fed to the second magazine by the forward rotation of the platen. During the forward rotation of the platen for feeding the sheets, therefore, the feed rollers of the sheet feeding unit must be disengaged from the drive system.

As is disclosed in Japanese Patent Disclosure No. 8054/85, a one-way clutch is generally used to engage a sheet feed shaft with a drive system and to disengage the shaft from the system. In the conventional clutch of this type, a drive disk is rotatably mounted on the sheet feed shaft, which is rotatably supported by the sheet feeding unit. The drive disk includes a gear which meshes with a gear train operatively connected to the platen. An endless guide groove is formed in the outer peripheral surface of a clutch disk, which is rotatably mounted on the sheet feed shaft and is coaxially arranged adjacent to the drive disk. Formed in the guide groove are a stop used for free forward rotation of the clutch disk, and a slit at a predetermined angular distance from the stop. A ratchet pawl is rockably mounted on the drive disk by means of a pin, and is urged by a spring so that its tip is pressed against the guide groove. Guide surfaces are formed on the respective end of a range covering the slit. The guide surface on the upstream end thereof, when viewed in relation to the direction of forward rotation of the clutch disk, guides the ratchet pawl to the other guide way than the slit when the guide surface on the other end of the slit range leads the ratchet pawl to the slit when the drive disk rotates reversely. Through the slit, the pawl engages a drive gear fixed to the feed shaft in the clutch disk. After this engagement, the forward rotation of the drive disk transmits the rotation of the drive disk to the drive gear, enabling the clutch mechanism to be in an "on" position.

In starting the printer with the conventional sheet feeding clutch, after filling the first magazine with paper sheets, the platen shaft is first manually rotated forwardly or in the sheet feeding direction through a desired angle (for example, 180°), whereupon the drive disk rotates in the same direction. After the tip of the ratchet pawl has engaged the stop, the clutch disk rotates in the same direction, with the pawl abutting against the stop. Thus, the positional relation between the clutch disk and the drive disk is settled.

A switch for automatic operation of the printer unit is turned on. Then, platen rotates in accordance with a program stored in a control device. The drive disk first rotates reversely through a predetermined angle, so that the ratchet pawl disengages from the stop and slides along the guide groove until it drops into the slit, thereby engaging the drive gear.

In response to a subsequent forward-rotation command from the program, both the platen and the drive disk rotate forwardly. At the same time, the drive disk and the drive gear which are engaged with the former by way of the ratchet pawl, rotate forwardly as a unit. As a result, the sheet feed shaft rotates, so that the topmost one of the paper sheets in the first magazine is delivered to the platen. When the sheet reaches the platen, the feed shaft ceases rotating. Thereafter, the drive disk is rotated reversely by the platen in response to a reverse-rotation command, whereby the clutch is in an "off" position.

Then, the program proceeds to a normal printing process. In this state, the platen, along with the drive disk, is rotated forwardly. Since the clutch is an "off" position, however, this rotation is not transmitted to the sheet feed shaft.

When the relative positional relation between the drive disk and the clutch disk is established before the starting of the printer, in the sheet feeding clutch described above, it is possible that the ratchet pawl may drop into the slit and engage the drive gear, thus making the clutch in the "on" condition and feeding sheets as the drive disk rotates forwardly. In such a case, the clutch cannot be initialized, and even if the printer unit is not in a printing mode, the sheets are erroneously fed.

Disclosed in German Patent Publication No. 2910849C2 is a sheet feeding apparatus mounted on a printer, wherein a paper sheet is fed backwardly by a distance corresponding to a desired number of lines on the sheet, during a printing operation, in order to print, for example, an exponent on the sheet. This apparatus, however, has a problem in that the number of lines to be returned can be changed only when a pin or sector is replaced.

SUMMARY OF THE INVENTION

The object of the invention is to provide a sheet feeding clutch mechanism, wherein the initialization of the clutch is ensured without considering on what part of the guide groove the ratchet wheel is resting before starting the printing operation, and wherein the number of print lines for return feed can be changed without replacing any parts and/or components.

In order to achieve the above object, a sheet feeding clutch mechanism according to the invention comprises:

a drive disk rotatably mounted on a sheet feed shaft of a sheet feeding unit;

a clutch disk having a pawl guide groove on its outer peripheral surface, and rotatably mounted on the feed shaft, so as to be coaxially mounted adjacent to the drive disk; and a drive gear fixed to the feed shaft in the clutch disk.

A ratchet pawl is pivoted to the drive disk and slidably contacts the pawl guide groove of the clutch disk. While the drive disk rotates forwardly, the pawl engages the drive gear by way of a slit in the guide groove. A first initializing stop is formed in the guide groove of the clutch disk, for engaging the ratchet pawl when the drive disk rotates forwardly. A second initializing stop is formed on the outer peripheral surface of the clutch disk, and engages the pawl during the reverse rotation of the drive disk.

In the process of initializing the clutch, the drive disk is rotated reversely through a desired angle. At first, a pawl supporting portion of the drive disk abuts against the second initializing stop and then rotates the clutch disk to a desired angular position. Thereafter, the drive disk is rotated forwardly through a desired angle. The ratchet pawl engages the first initializing stop, and rotates the clutch disk to a predetermined angular position. The drive disk and the clutch disk take required relative positions to each other.

Thus, in the clutch mechanism of the invention, the initialization of the clutch is ensured without the need to use a special pawl mechanism, and without the need to consider on what part of the guide groove the ratchet wheel is resting. With this arrangement, erroneous feeding of sheets, due to the failure of the initialization of the clutch, is prevented. Besides, return feed for the printing of exponents and other symbols can be effected easily and freely.

BRIEF DESCRIPTION OF THE DRAWINGS

This invention can be fully understood from the following detailed description with reference to the accompanying drawings, in which.

DETAILED DESCRIPTION OF THE PREFERRED EMBODIMENTS

Figure 1:
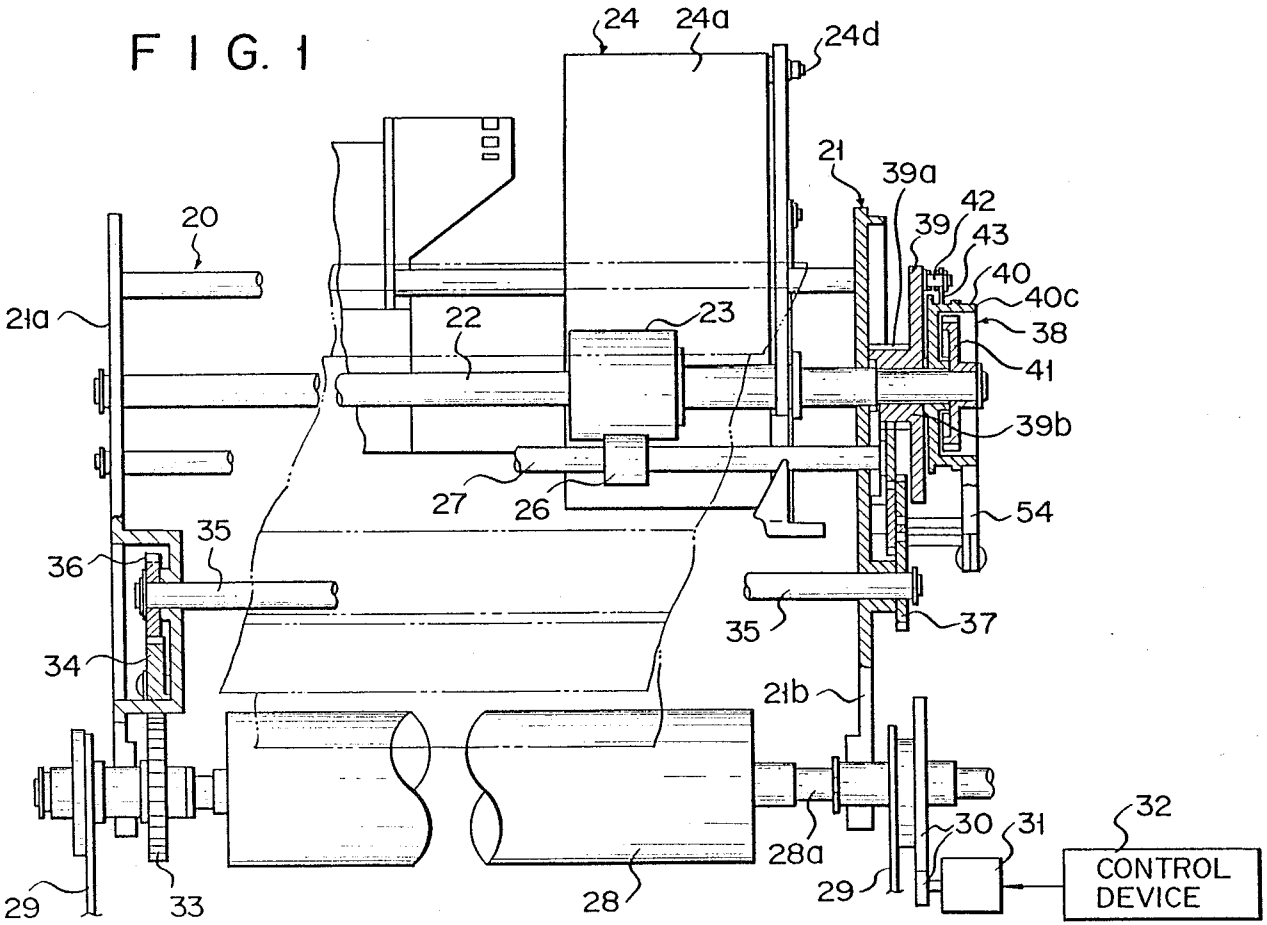
FIG. 1 is a partial cutaway front view showing the main part of a printer unit provided with a sheet feeding unit having a sheet feeding clutch mechanism according to the invention.
Figure 2:
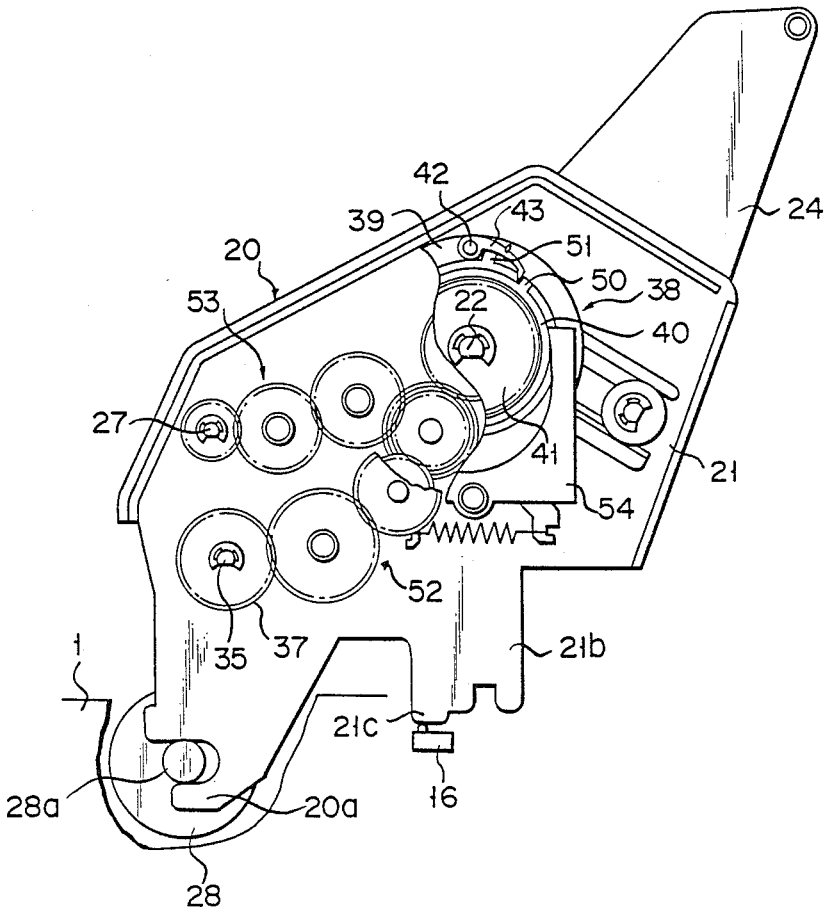
FIG. 2 is a right-side view of the printer unit shown in FIG. 1.

FIGS. 1 and 2 show an automatic sheet feeding unit 20, which has frame 21 removably mounted on the top portion of printer unit 1. Sheet feed shaft 22 extends between a pair of side plates 21*a* and 21*b* of frame 21. The ends of shaft 22 are rotatably supported by corresponding side plates 21*a*, 21*b*. Feed rollers 23, made of rubber, are mounted on shaft 22. Between rollers 23 and shaft 22 is one-directional rotating mechanism 2 (FIGS. 18 and 19), which will be described in detail later.

Figure 3:
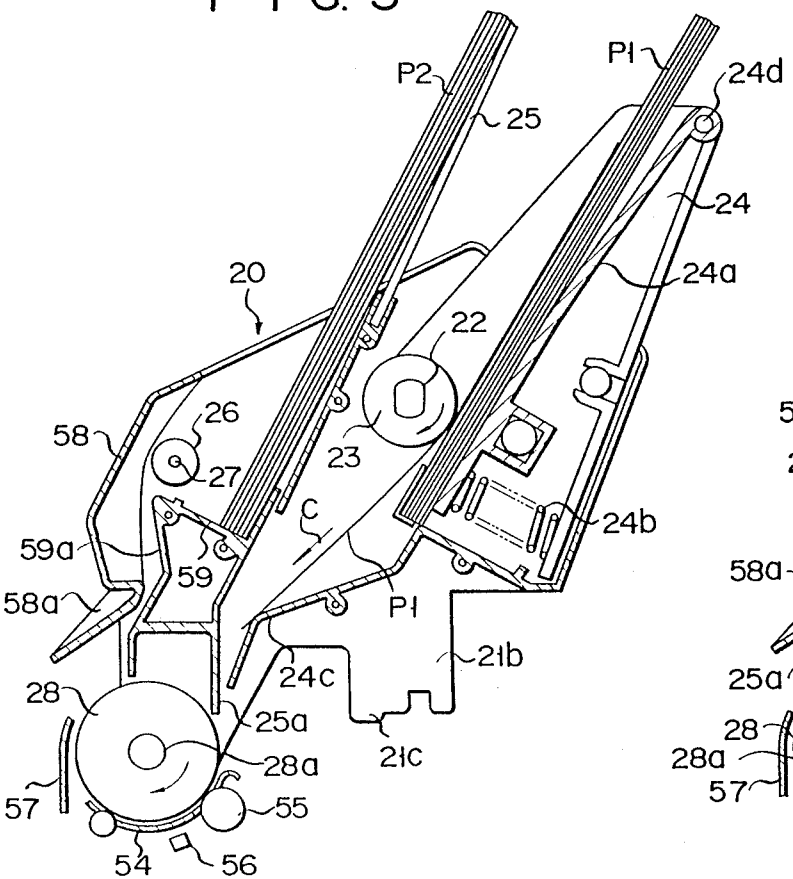

First magazine (paper-feed magazine) 24 is mounted on frame 21, behind shaft 22. As is shown in FIG. 3, magazine 24 is located with a stack of unprinted paper sheets P1. It is provided with pressure plate 24*a*, which presses the stack of sheets P1 against feed rollers 23. Plate 24*a* is pivotally supported, at its upper end, on both side walls of magazine 24 by pivots 24*d* and is urged by coil spring 24*b* towards feed rollers 23. Chute 24*c* extends slantwise from the lower end of first magazine 24 toward the rear portion of platen 28.

Figure 4:
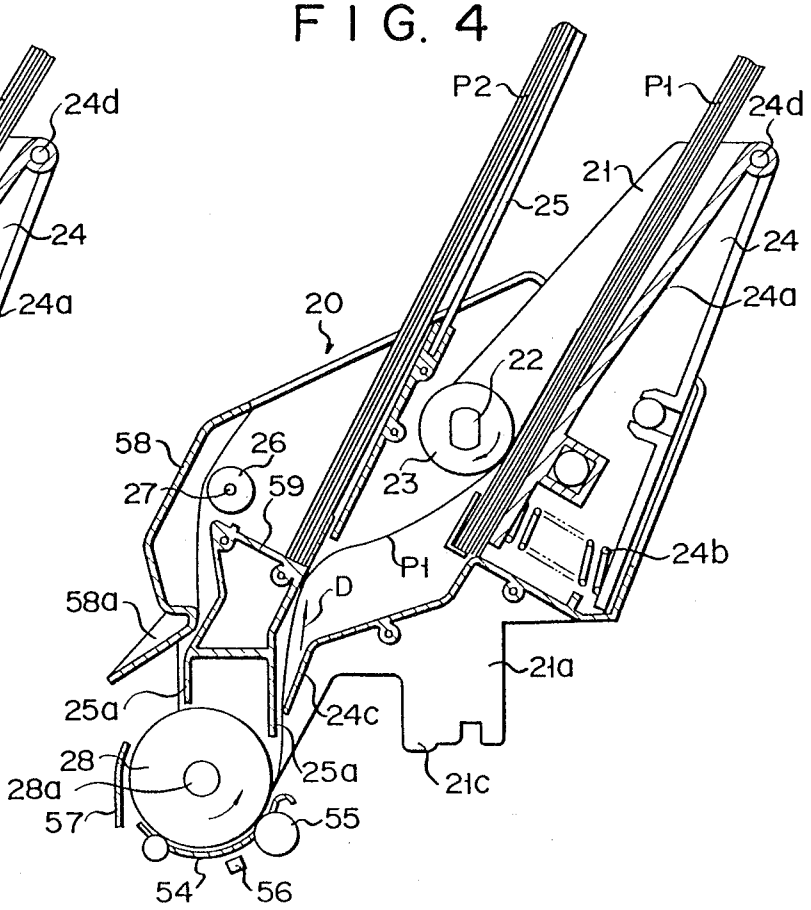
FIGS. 3, 4, and 5 respectively show sheet feed operation modes, elimination of sheet skewing, and sheet discharge, in the arrangement of FIG. 1.

As is shown in FIGS. 3 and 4, second magazine 25 for receiving printed paper sheets P2 is mounted on frame 21 in front of sheet feed shaft 22.

Release rollers 26 in front of magazine 25 are mounted on sheet-release roller shaft 27, which is rotatably supported by side plates 21*a* and 21*b* of frame 21. Platen 28 of printer unit 1 is rotatably mounted, at both ends of its shaft 28*a*, on frame 29 of printer unit 1. Shaft 28*a* is releasably received by lower ends 20*a* of side plates 21*a*, 21*b* as is shown in FIG. 2, and is connected to small DC motor 31 by means of gear train 30, as is shown in FIG. 1. Control device 32 controls motor 31, which is used to feed and discharge the paper sheets.

As is shown in FIG. 1, platen gear 33 mounted on the remoter end of platen shaft 28*a* from motor 31 engages intermediate gear 34 mounted on side plate 21*a* of frame 21. Gear 36, in mesh with gear 34, is fixed to one end of rotation-transmitting shaft 35, which is rotatably supported by side plates 21*a* and 21*b* of frame 21. Gear 37 is mounted on the other end of shaft 35.

Clutch 38 transmits rotational movement only in one direction (the sheet feeding direction), from platen 28 to sheet feed shaft 22. It includes drive disk 39 rotatably mounted on one end of shaft 22, clutch disk 40 rotatably mounted on shaft 22 and located close to disk 39, and drive gear 41 concentrically fixed to shaft 22 in disk 40. The clutch further includes pin 42 projecting axially from the outer portion a side wall of drive disk 39, and ratchet pawl 43 having one end pivotally mounted on pin 42.

Referring to FIGS. 10 to 14, tip 43*a* of ratchet pawl 43 is continually pressed by spring 44, against endless guide groove 40*a*, which is formed in the outer cylindrical peripheral surface of clutch disk 40. Separation wall 45 is formed on the center line of part of guide groove 40*a*, extending in the circumferential direction thereof. Thus, wall 45 divides part of groove 40*a* into two parallel pawl guide passages 46 and 47.

Figure 9:
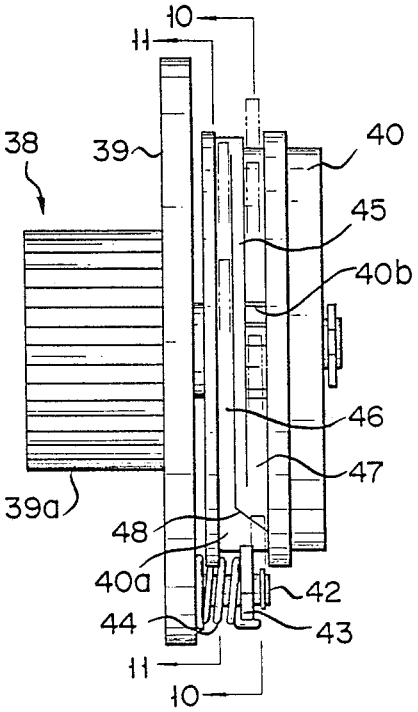
FIG. 9 is a front view of the clutch mechanism shown in FIG. 1.
Figure 10:
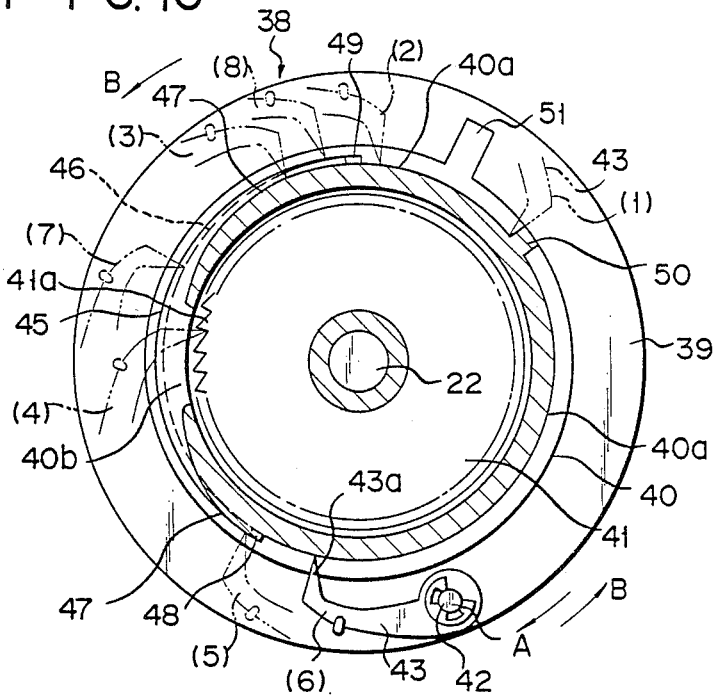
FIG. 10 is a sectional view taken along line 10—10 of FIG. 9.
Figure 11:
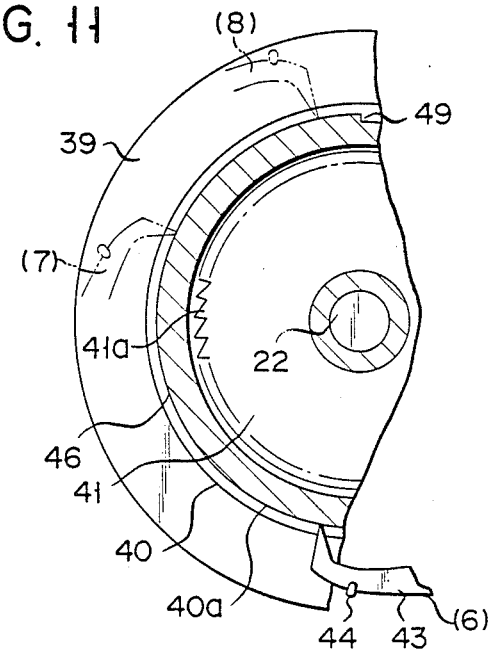
FIG. 11 is a sectional view, taken along line 11—11 of FIG. 9, showing the relative positions of a pawl guide groove and a ratchet groove.
Figure 12:
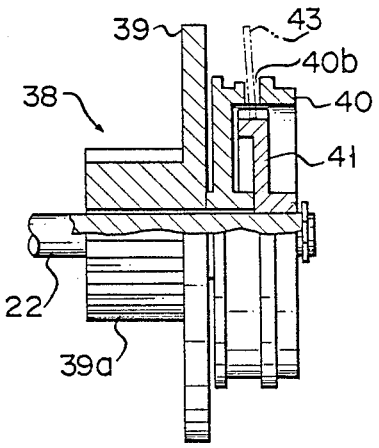
FIG. 12 is a view the clutch mechanism wherein the ratchet pawl is in engagement with a tooth of a drive gear.
Figure 13:
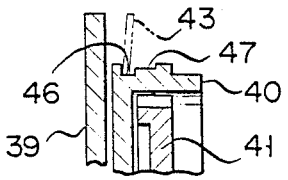
FIG. 13 is a view of the clutch mechanism in which the tip of the ratchet pawl is in contact with a pawl guide passage without a slit.

As is shown in FIGS. 9 to 11, pawl guide passage 46 rises gradually in the radial direction of drive disk 39, from the upper-course side of separation wall 45 toward the lower-course side thereof, in relation to the direction of forward rotation (indicated by arrow A in FIG. 10) of disk 39. Passage 46 terminates at pawl course-changing surface 49 on the lower-course end of wall 45. Surface 49 extends at right angles to guide groove 40*a*, and inclines toward pawl guide passage 47. If drive disk 39 is rotated reversely (in the direction indicated by arrow B in FIG. 10), pawl 43 is guided, by surface 49, from position (1) or (2) on groove 40*a* to position (3) on passage 47. Guide passage 46 can be referred to as a pawl-passing guide passage.

Guide passage 47 has slit 40*b* in its central portion. As drive disk 39 is rotated reversely, tip 43*a* of ratchet pawl 43, guided into passage 47, drops into slit 40*b*, as indicated by position (4), and engages tooth 41*a* of drive gear 41 by the urging force of spring 44 (see FIGS. 10 and 12).

Guide passage 47 rises gradually in the radial direction of drive disk 39, from the lower-course side of partition wall 45 toward the upper-course side thereof, in relation to the direction of forward rotation of disk 39. Passage 47 terminates at pawl course-changing surface 48, on upper-course end of wall 45. Surface 48 extends at right angles to guide groove 40*a*, and inclines toward guide passage 46. As drive disk 39 is further rotated reversely, pawl 43 is disengaged from tooth 40*b* and is guided to position (6) on groove 40*a* via position (5) on passage 47 (see FIGS. 10 and 14). Guide passage 47 can be referred to as a pawl-engaging guide passage.

Figure 14:
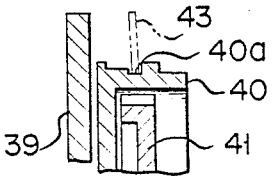
FIG. 14 is a view of the clutch mechanism in which the tip of the ratchet pawl rests on a pawl guide passage with a slit.

As drive disk 39 is rotated forwardly from position 6, ratchet pawl 43 is led to guide passage 46 by surface 48. Further forward rotation of disk 39 brings pawl 39 to position 7 or 8 on passage 46 (FIGS. 11 and 14).

First initializing stop 50 is formed in guide groove 40*a* so as to be separated from slit 40*b*, by a desired angular distance in the direction of forward rotation. As drive disk 39 rotates forwardly, tip 43*a* of ratchet pawl 43 comes to engage stop 50. Also, second initializing stop 51 is formed on the outer peripheral surface of clutch disk 40 so as to be separated from first stop 50, by a desired angular distance in the direction of reverse rotation. Pin 42 of ratchet pawl 43 engages stop 51 as disk 39 rotates reversely.

In FIGS. 1 and 2, gear train 52 transmits the rotation of rotation-transmitting shaft 35 from gear 37 to gear 39*a* fixed to boss 39*b* of drive disk 39. Gear train 53 transmits the rotation of shaft 35 to sheet-release roller shaft 27 via gear train 52. Gear trains 52 and 53 are arranged on side plate 21*b* of frame 21. Brake device 54 is pressed resiliently against outer peripheral surface 40*c* of the clutch disk 40. Thus, disk 40 is prevented from being overdriven, despite its inertia.

Figure 5:
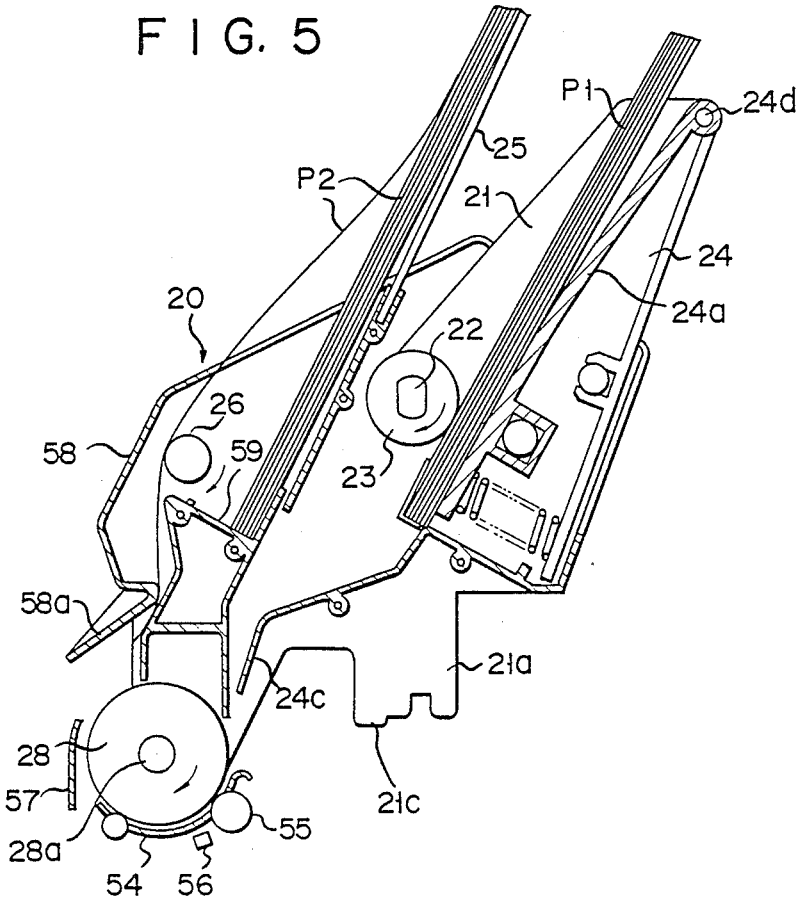

Referring to FIGS. 3 to 5, lower plate 25*a* of second magazine 25 faces chute 24*c*, and extends downward towards the rear portion of platen 28.

Sheet deflector 54 coaxially surrounds the lower portion of platen 28, extending forwardly from a position under lower plate 25*a* of second magazine 25, and at the rear portion of the platen 28.

Rubber pinch rollers 55 press against the lower back portion of platen 28. Optical detectors 56 are provided in front of rollers 55, for detecting the leading and training ends of each paper sheet, delivered to platen 28 as is mentioned later.

Guide plates 57 are located in front of platen 28. They direct upwardly the paper sheets passing through the space between platen 28 and deflector 54.

Second magazine 25 has at its lower end platform 59, the front edge of which is situated under paper-release roller 26. Platform 59 supports the lower edges of printed paper sheets P2.

Front cover 58 is removably attached at both its side edges to corresponding side plates 21*a* and 21*b* of frame 21. Cover 58 is located in front of second magazine 25, so as to cover rollers 26 and platform 59.

Sheet feeder connection switch 16, constituted by, for example, a microswitch, is provided in printer unit 1. When both side plates 21*a* and 21*b* of frame 21 are inserted into unit 1, in order to mount automatic sheet feeding unit 20 on the printer unit, lower end 21*c* of plate 21*b* presses switch 16 (FIGS. 2, 20), thereby closing the circuit of control device 32.

Figure 20:
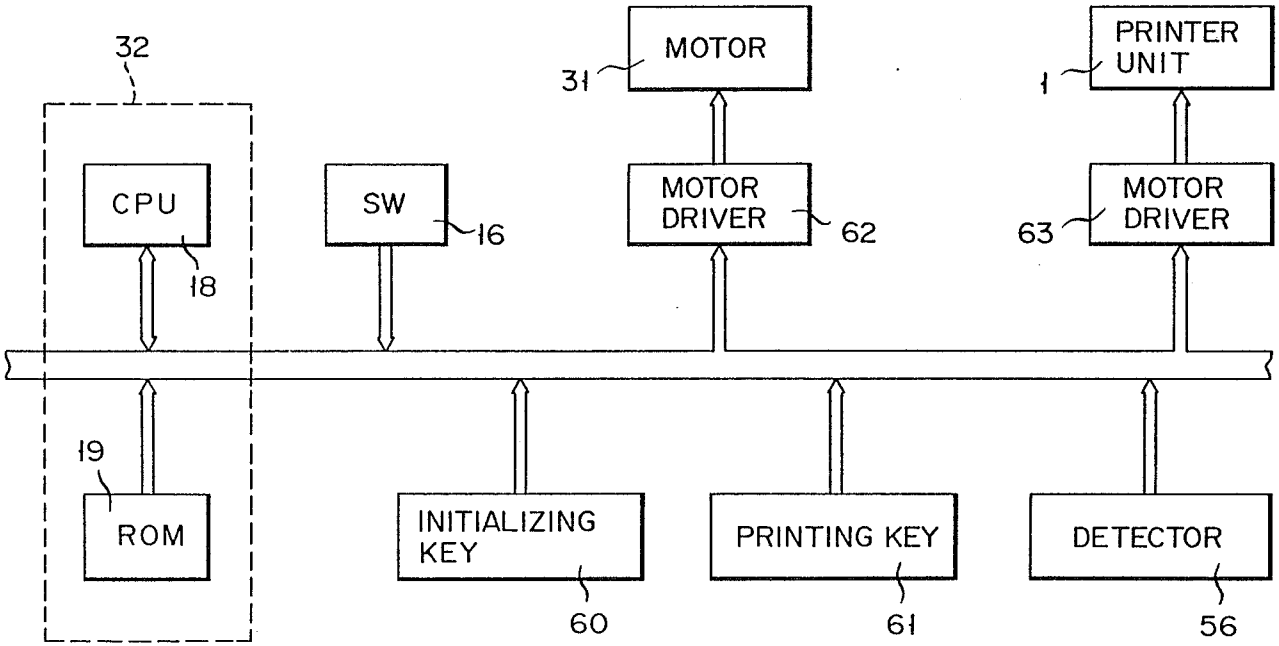
FIG. 20 is a block diagram for executing the flow chart of FIG. 19.

Arranged on printer unit 1 is a control panel including initializing key 60 and printing key 61, as is shown in FIG. 20. Key 60 initializes automatic sheet feeding unit 20.

In this embodiment, substantially one complete rotation (360°) of drive disk 39 corresponds to 15 print lines on paper sheet P1. Slit 40*b* of clutch disk 40 is formed at an angular distance equivalent to substantially half a complete rotation of drive disk 39, in the direction of reverse rotation, as indicated by arrow B in FIG. 18, from first initializing stop 50. Substantially half a complete rotation of disk 39 corresponds to 7 print lines on sheet P1.

When feeding unit 20 is mounted on printer unit 1, lower end 21*c* of side plate 21*b* of unit 20 depresses feeder connection switch 16 in the printer unit. This depression is detected by CPU 18, in step S1 of FIG. 19A. Preferably, printer unit 20 has mounting-indicator means (not shown), such as a lamp, which glows only when feeding unit 20 is correctly mounted. If the indicator means is off, the mounting operation must then be repeated.

Figure 15:
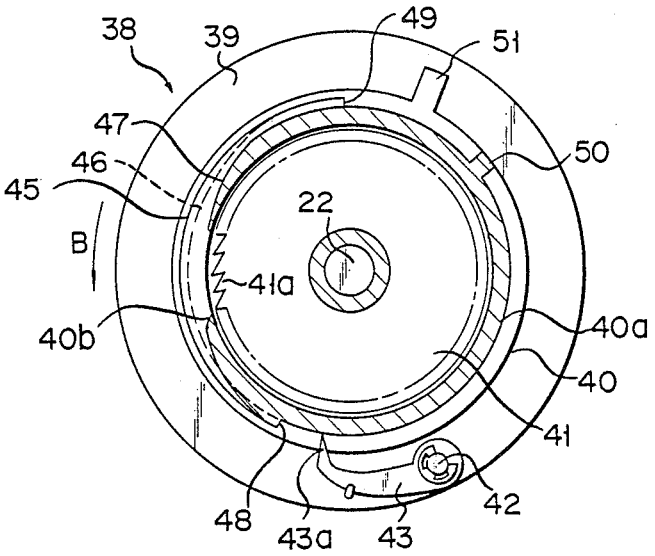
FIG. 15 is a front view showing the clutch mechanism in which the sheet feeding unit is mounted on the printer unit.

Let it be assumed that the elements of clutch 38 are arranged as shown in FIG. 15, after sheet feeding unit 20 has been mounted on printing unit 1.

Thereafter, initializing key 61 is depressed, and CPU 18 detects this, in step S2. Thereupon, CPU 18 outputs the command of step S3 to motor driver 62 (FIG. 20) in printer unit 1, to deliver a pulse signal to the motor, if it is a pulse motor. In response to this pulse signal, motor 31 is driven reversely for a predetermined rotational angle, which corresponds to substantially one complete rotation of drive disk 39 (equivalent to 15 print lines on the paper sheet), in the direction of reverse rotation, indicated by arrow B in FIG. 15. The next step may be entered after CPU 18 confirms that the desired pulse signal has been transmitted to motor 31, or without such confirmation by CPU 18. In the latter case, motor 31 is considered to have rotated reversely through the desired angle, after the end of a predetermined period of time, in step S2.

Figure 16:
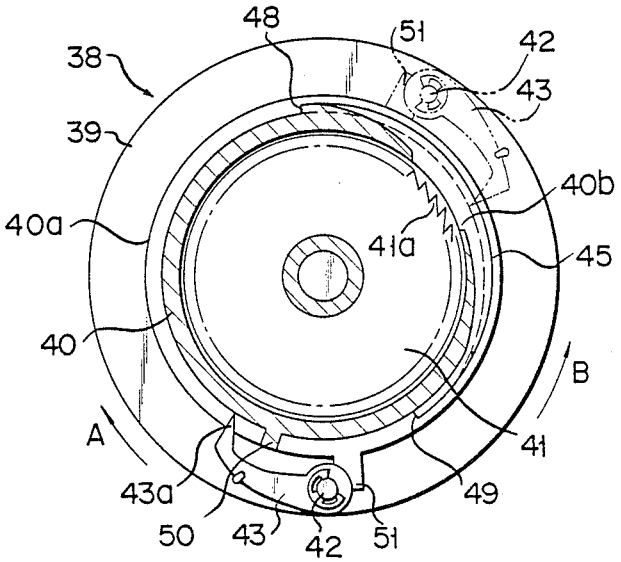
FIGS. 16 and 17 illustrate the procedure for initializing the clutch mechanism.

In step S3, motor 31 rotates drive disk 39 through substantially one complete reverse rotation, from the state of FIG. 15 to the state of FIG. 16, via gear train 30, platen 28, gears 33 and 34, rotation-transmitting shaft 35, gears 36 and 37, and gear train 52. As disk 39 rotates reversely, pin 42 abuts, at first, against second initializing stop S1, as is indicated by the two-dot chain line shown in FIG. 16. The reverse rotation of clutch disk 40 continues until stop 51 arrives at the position of pin 42, as indicated by the full line shown in FIG. 16. This position is the same as that of pin 42 in FIG. 15, or is in the vicinity thereof. This one complete reverse rotation of drive disk 39 is intended to lead tip 43*a* of ratchet pawl 43 to slitless guide passage 47, as drive disk 39 is forwardly rotated after the initialization, if second initializing stop 51 is not situated at any specific position when sheet feeding unit 20 is mounted on printer unit 1, whereby feed rollers 23 are prevented from rotating to feed the paper sheets.

Then, CPU 18 outputs the command of step S4 to motor driver 63. In this step, motor driver 63 delivers a pulse signal to motor 31. In response to this signal, motor 31 is driven forwardly for a predetermined rotational angle, which corresponds to substantially one complete rotation of drive disk 39, in the direction of forward rotation, as indicated by arrow A in FIG. 16.

Thus, immediately before drive disk 39 makes substantially a complete rotation, tip 43*a* of ratchet pawl 43 abuts against first initializing stop 50. Then, clutch disk 40 is rotated forwardly until stop 50 arrives at the position shown in FIG. 17. The distance between first and second initializing stops 50 and 51 is determined, so that pin 42 does not abut against second stop 51 before tip 43*a* of pawl 43 engages first stop 50. In this way, clutch 38 is initialized.

Figure 17:
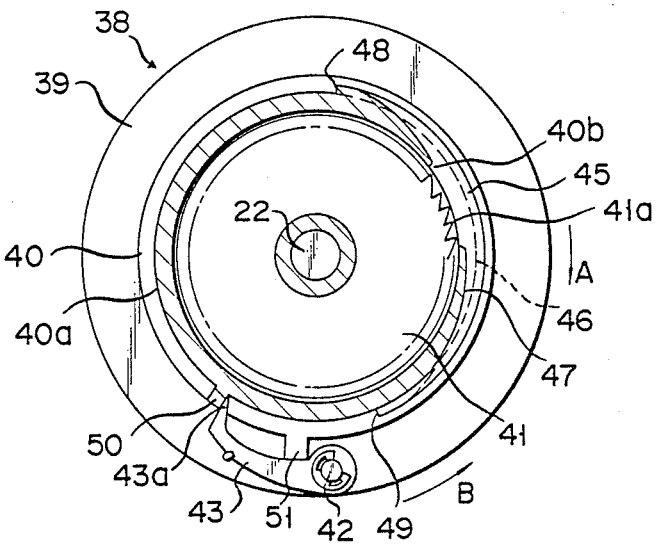
Figure 18:
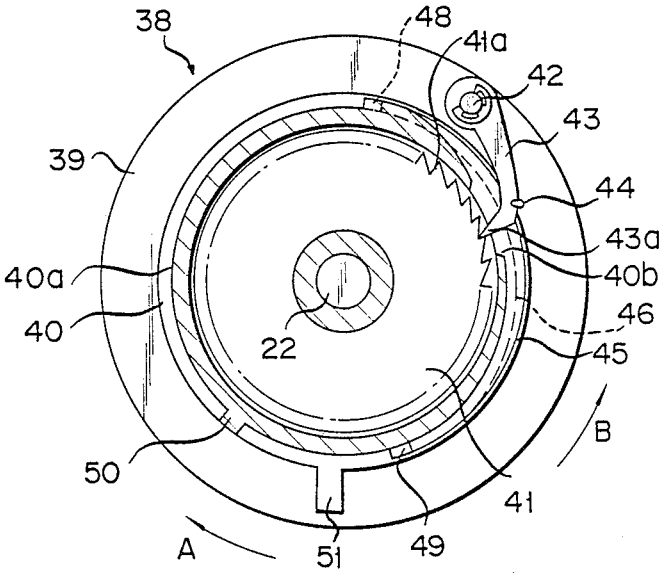
FIG. 18 shows the arrangement of the clutch mechanism wherein the ratchet pawl engages the drive gear by reverse rotation of a clutch disk of the clutch mechanism from the arrangement in FIG. 17.

After the depression of printing key 61 (FIG. 20) is detected, in step S5, control proceeds to step S6, wherein motor 31 is reversely driven, so as to reversely rotate drive disk 39 by substantially half a complete turn (which corresponds to 7 print lines on each sheet of paper), from the position of FIG. 17. Tip 43*a* of ratchet pawl 43 engages tooth 41*a* of drive gear 41 by the urging force of spring 44 through slit 40*b*, as is shown in FIG. 18. Clutch 38 is in the "on" condition.

Figure 6:
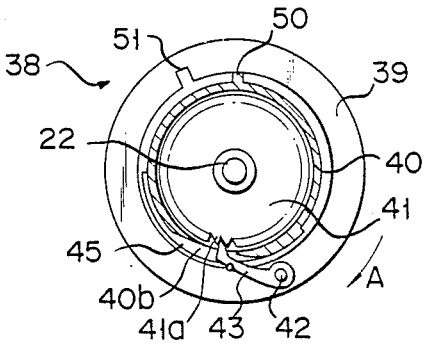
FIGS. 6, 7 and 8 show the relative positions of the components of the clutch mechanism, corresponding to the operation modes shown in FIGS. 3, 4 and 5, respectively.

In step S7, motor 31 is driven forwardly, so that the entire clutch including drive gear 41 rotates forwardly, as is shown in FIG. 6. As a result, feed rollers 23 are rotated in the same direction, thereby separating the topmost one of paper sheets P1 from the remaining sheets in first magazine 24, and feeding it in the direction of arrow C shown in FIG. 3. Sheet P1 is guided by chute 24*a* and lower plate 25*a* to the region behind platen 28. After the sheet is held by platen 28 and pinch rollers 55, and passes therebetween, it is moved onto deflector 54.

When the leading end of sheet P1 arrives directly above detectors 56, the detectors output detection signals to CPU 18, in step S8. In step S9 in FIG. 19B, motor 31 is further driven forwardly to rotate platen 28 through an angle which corresponds to 3 print lines on sheet P1, and then the motor is stopped. At this point in time, the leading edge of sheet P1 is situated 4 print lines ahead of the contact line defined by platen 28 and pinch rollers 55.

In step S10, motor 31 is driven reversely until platen 28 is rotated reversely through an angle corresponding to 4 print lines on sheet P1, as is shown by arrow B in FIG. 4. Thus, sheet P1 is fed back so that its leading edge is situated on the contact line between platen 28 and pinch rollers 55. As ratchet wheel pawl 43 is reversely rotated, its tip 43*a* is disengaged from tooth 41*a* of drive gear 41, passes the passage 47 and is moved onto guide groove 40*a*, as is indicated by the imaginary line shown in FIG. 7. Thus, clutch 38 is placed in the "off" condition in which it does not rotate feed rollers 23. As a result, sheet P1 is curved, as is shown in FIG. 4, so that the leading edge of the sheet becomes parallel to the contact line between platen 28 and pinch rollers 55, that is, skewing of sheet P1 is eliminated.

After the skewing has been eliminated, motor 31 is forwardly driven, in step S11, so that sheet P1 is advanced by platen 28. When the leading edge of sheet P1 again arrives directly above detectors 56, detectors 56 send the thus detected signal to CPU 18, in step S12. Then, in step S13, motor 31 is driven forwardly, and platen 28 advances sheet P1 by, for example, a distance equivalent to 5 print lines. Thus, the starting position for printing on sheet P1 is established.

Subsequently, control proceeds to step S14. Motor 31 is driven forwardly, to rotate platen 28 for printing feed. In synchronism with this operation, CPU 18 delivers a printing command to the typing device (not shown) in step S15.

After the printing, motor 13 is further driven forwardly, in step S16, in order for platen 28 to feed the sheet until CPU 18 receives, from detectors 56, the signal indicating that the trailing edge of the sheet has passed under detectors 56, in step S17.

In step S18, motor 31 is driven forwardly to forwardly rotate platen 28 for a predetermined number of revolutions whereby printed sheet P2 is fed through guide plates 57, guide portion 58*a* of front cover 58, guide portion 59*a* forming the front part of platform 59 and sheet-release rollers 26 into second magazine 25 with its lower edge resting on platform 59.

Figure 7:
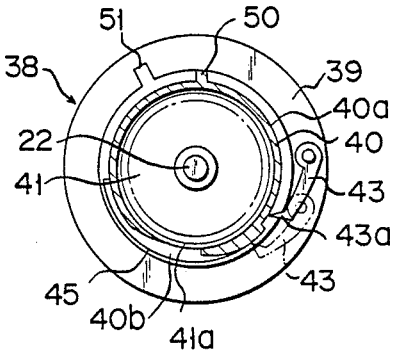
Figure 8:
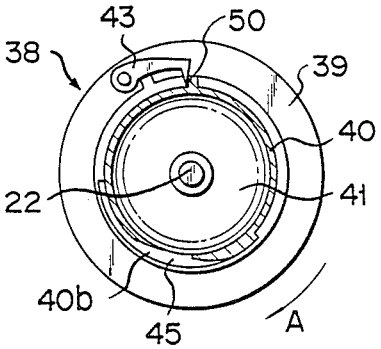

In step S11, pawl 43, together with drive disk 39, rotates forwardly or in the direction of arrow A shown in FIG. 8, from the full-line position of FIG. 7. Tip 43*a* of pawl 43 is guided to slitless passage 46 by surface 48, and engages first initializing stop 50. Thereafter, pawl 43 continues to abut against stop 51, and rotates together with clutch disk 40 in the forward direction, to reach the position of FIG. 8. In step S13 through step S18, drive disk 39 and clutch disk 40 rotate forwardly, with pawl 43 abutting against stop 50. Since pawl 43 is not in engagement with drive gear 41, in steps S10 through S18 clutch 38 is in the "off" condition. Although platen 28 rotates forwardly, therefore, feed rollers 23 are forwardly rotated by sheet P1, which is fed by platen 28, but they do not feed the sheet. In other words, feed rollers 23 make an idle movement.

Thereafter, CPU 18 checks the presence of the next page to be printed, in step S19. If the next page is present, the control returns to step S6, wherein pawl 43 again engages drive gear 41 by the reverse rotation of motor 31. Then, the subsequent steps proceed whereby the next page is printed.

If there are no remaining pages to be printed, the printer stops.

The control device as described above is only one example of a device for controlling the clutch mechanism of the invention.

Figure 19A:
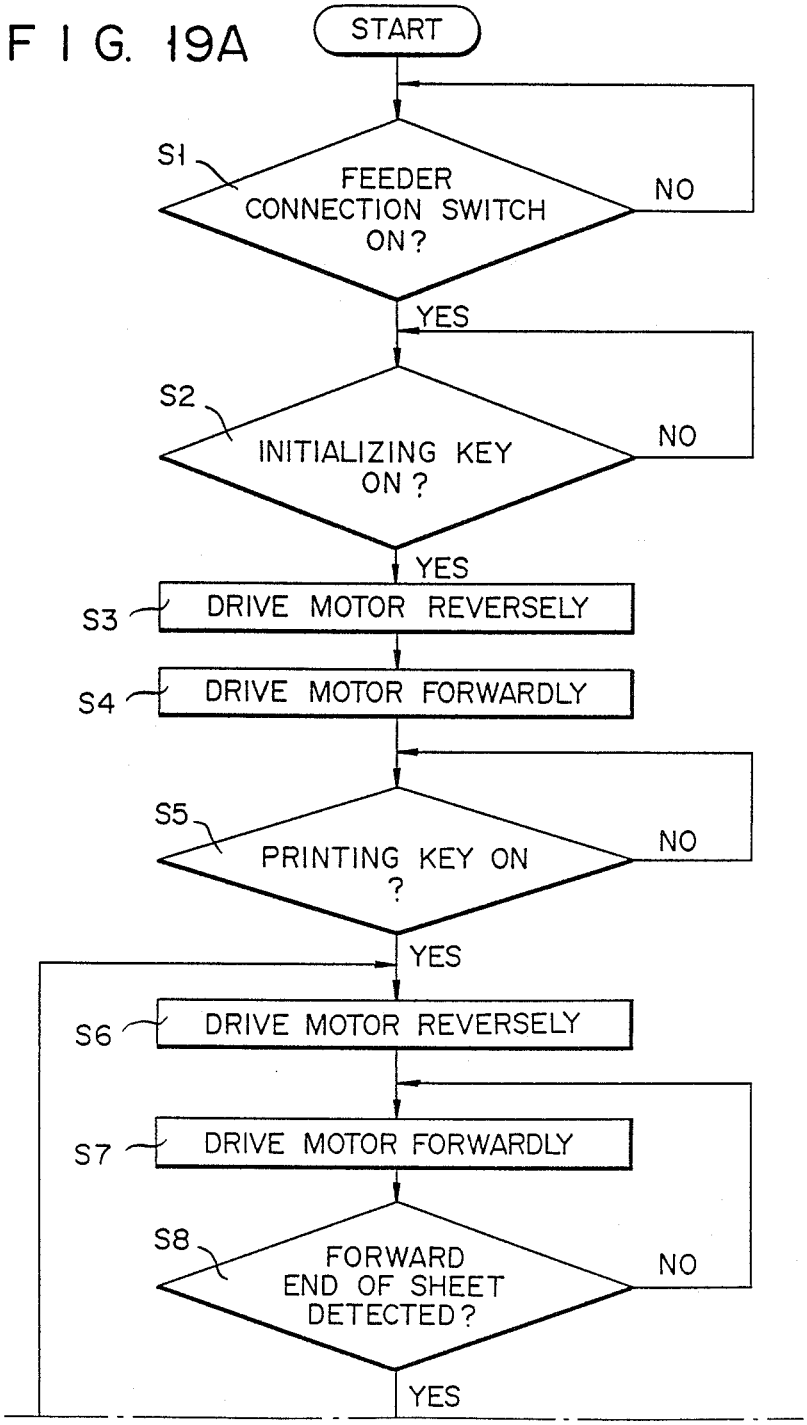
FIGS. 19A and 19B show a flow chart of a program for operating the clutch mechanism.
Figure 19B:
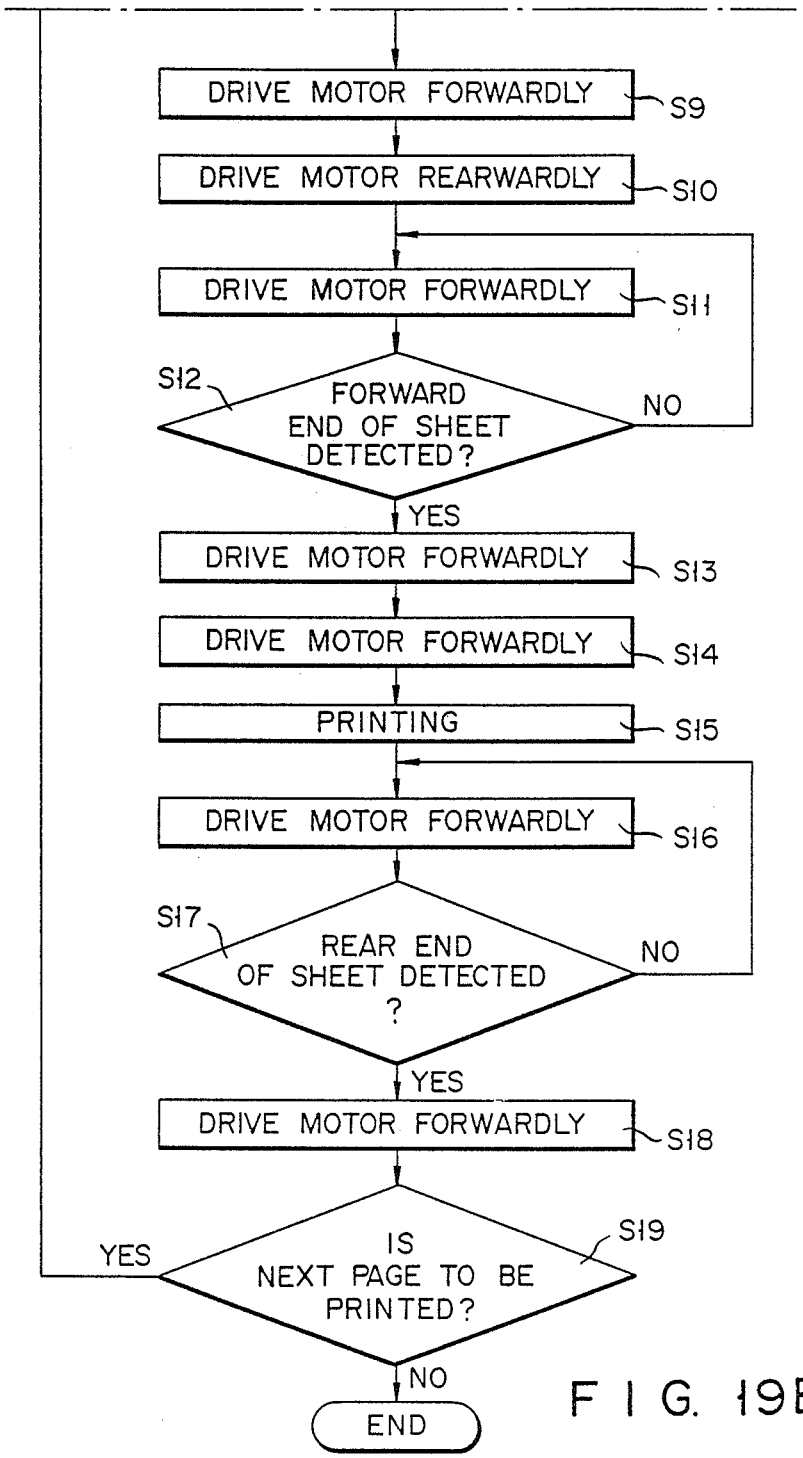

An alternative control device can be also applicable which is operated according to a new flow chart in which step S5 in FIG. 19A comes before step S1 and step S2 is deleted.

In initializing clutch 38, according to the embodiment of the invention, the relative positional relation between drive disk 39 and clutch disk 40 is determined as follows: First, in order to prevent ratchet pawl 43 from unexpectedly engaging drive gear 41 through slit 40*b*, drive disk 39 is reversely rotated through a desired angle (for example, approx. 360°), so as to engage pin 42 with second stop 51 for rotating clutch disk 40 in the same direction. Thus, the first step of initialization of clutch disk 40 is attained. This step ensures that pawl 43 is guided accurately to guide passage 46 when drive disk 39 is forwardly rotated. Thereafter, drive disk 39 is forwardly rotated through a desired angle (for example, approx. 360°), thereby engaging ratchet pawl 43 with first stop 50, and then rotating clutch disk 40 in the same direction. Unlike the prior art clutch mechanisms, therefore, the automatic initialization of the clutch is guaranteed, requiring no manual operation.

The invention is not limited to the embodiment described above. For example, the circumferential relative positional relation between the first and second initializing stops can be arbitrarily selected.

What is claimed is:

1. A sheet feeding clutch mechanism for a sheet feeding unit having a sheet feed shaft, comprising:

a drive disk mounted on the sheet feed shaft of the sheet feeding unit, said drive disk being rotatable in one direction and the other direction opposite thereto;

a clutch disk rotatably mounted on the sheet feed shaft and arranged coaxially with the sheet feed shaft, said clutch disk having an outer peripheral surface;

a pawl guide groove formed circumferentially in the outer peripheral surface of the clutch disk and having a range provided with a circumferentially extended slit;

a drive gear coaxially provided in the clutch disk and rotatable relatively thereto, said drive gear being fixed coaxially to the sheet feed shaft;

a ratchet pawl pivoted to the drive disk and slidably contacting the pawl guide groove and engageable with the drive gear through the slit;

pawl leading means provided in said range of the pawl guide groove, for dividing said range into a first pawl guide passage which does not include the slit and a second pawl guide passage which includes the slit, and for leading the ratchet pawl to the first pawl guide passage when the drive disk is rotated in said one direction with respect to the clutch disk, and leading the ratchet pawl to the second pawl guide passage when the drive gear is rotated in said other direction with respect to the clutch disk;

a first initializing stop formed in the guide groove of the clutch disk for contacting the ratchet pawl when the drive disk rotates in said one direction with respect to the clutch disk; and a second initializing stop formed on the outer peripheral surface of the clutch disk for contacting the ratchet pawl when the drive disk rotates in said opposite direction with respect to the clutch disk.

2. The clutch mechanism according to claim 1, wherein said first initializing stop is separated from said second initializing stop at such a predetermined angular distance in said one direction that the ratchet pawl is prevented from contacting the second initializing stop when the ratchet pawl engages the first initializing stop.

3. The clutch mechanism according to claim 2, wherein said slit is separated from the first initializing stop at an angular distance equivalent to substantially half one complete turn of the clutch disk in said other direction.

4. The clutch mechanism according to claim 1, wherein said ratchet pawl has a pin pivoted to the drive disk and engageable with the second initializing stop.

* * * * *

UNITED STATES PATENT AND TRADEMARK OFFICE

CERTIFICATE OF CORRECTION

PATENT NO. : 4,754,961

DATED : July 5, 1988

INVENTOR(S) : Syunsuke Tokuda and Kouichiro Kitazume

It is certified that error appears in the above-identified patent and that said Letters Patent is hereby corrected as shown below:

On the Title Page, Item [73], "Assignee: Daima Seiko Inc." should read --Assignee: Daiwa Seiko Inc.--.

Signed and Sealed this

Second Day of May, 1989

*Attest:*

DONALD J. QUIGG

*Attesting Officer*

*Commissioner of Patents and Trademarks*